US007750243B1

(12) United States Patent
Mumm et al.

(10) Patent No.: US 7,750,243 B1
(45) Date of Patent: Jul. 6, 2010

(54) WATER BLOCKED COMMUNICATION CABLE COMPRISING FILLING COMPOUND AND METHOD OF FABRICATION

(75) Inventors: Jeffrey H. Mumm, Marietta, GA (US); Kristina Elyse Harrell Anderson, Acworth, GA (US)

(73) Assignee: Superior Essex Communications LP, Atlanta, GA (US)

( * ) Notice: Subject to any disclaimer, the term of this patent is extended or adjusted under 35 U.S.C. 154(b) by 0 days.

(21) Appl. No.: 12/400,822

(22) Filed: Mar. 10, 2009

(51) Int. Cl.
*H01B 7/00* (2006.01)

(52) U.S. Cl. ..... 174/110 R

(58) Field of Classification Search ..... 174/110 R, 174/113 R, 116, 118, 120 R, 120 AR, 120 SR
See application file for complete search history.

(56) References Cited

U.S. PATENT DOCUMENTS 3,843,568 A * 10/1974 Woodland et al. ..... 521/54
3,893,962 A * 7/1975 Walton et al. ..... 523/173
5,461,195 A * 10/1995 Freeman et al. ..... 174/23 R
6,258,885 B1 * 7/2001 Heucher et al. ..... 524/484
7,247,796 B2 * 7/2007 Hagen et al. ..... 174/110 R
7,253,217 B2 8/2007 Sohal
2004/0063812 A1 * 4/2004 Sohal ..... 523/200
2005/0137290 A1 * 6/2005 Hagen et al. ..... 523/219
2008/0076854 A1 3/2008 Sohal
2008/0212927 A1 9/2008 Pavan et al.

* cited by examiner

*Primary Examiner*—William H Mayo, III
(74) *Attorney, Agent, or Firm*—King & Spalding

(57) ABSTRACT

A water blocked communication cable has an outer jacket defining an interior space, a plurality of conductors, such as a plurality of twisted conductor pairs, disposed within the interior space, and a thixotropic, cold pumpable filling compound disposed within the interior space between the plurality of conductors and the outer jacket. The filling compound consists, for example, of a refined mineral oil base and an organic polymeric gelling agent with a dispersion of micro spheres and has a dielectric constant not greater than 1.8.

18 Claims, 3 Drawing Sheets

WATER BLOCKED COMMUNICATION CABLE COMPRISING FILLING COMPOUND AND METHOD OF FABRICATION

FIELD OF THE INVENTION

The present invention relates generally to water blocked communication cable and more specifically to water blocked communication cable filled with a low density, high molecular weight filling compound within the cable that provides increased water blocking characteristics without diminishing the electrical performance of the cable.

BACKGROUND

An industry standard requirement for four-pair communication cable defined (as of the filing date of this application) in standards from the Telecommunications Industry Association/Electronic Industries Alliance, known as TIA/EIA-568, allows a propagation delay (ns/100 m) for a cable to be no greater, for example, than $534+(36/\sqrt{f})$ ns/100 m or 534 plus 36 divided by the square root of the frequency, expressed in nanoseconds per 100 meters of cable length. Computation of propagation delay is based on the velocity of propagation of a signal from one end of a conductor pair of a cable to the other end of the conductor pair of the cable and is related at least in part to the insulation material and the surrounding materials in the cable. Thus, if only air and the surrounding insulation are present in the communication cable, the signal propagation proceeds at a very high velocity. However, if oil or water or some other material is present surrounding the insulation, the velocity is considerably less.

Cables that are designed for outdoor applications require the incorporation of a water-blocking material between and around the conductor pairs to prevent water from entering the cable through the ends or through a damaged area such as a cut or tear in the outer jacket. Traditional water-blocking compounds greatly reduce the speed of the electrical signal, i.e., the velocity of signal propagation, through the cable and therefore cause excess delay between the time the signal is sent and the time it is received at the other end (i.e., propagation delay).

In order to achieve an acceptable velocity of propagation or propagation delay it has heretofore been necessary to use foamed insulation. The foaming is accomplished by incorporating small gas bubbles into the insulation matrix to reduce the dielectric constant of the insulation. However, not only does the presence of these bubbles greatly weaken and reduce the tensile strength of the insulation, it also makes the insulation less resistant to size distortion from crushing or compression and less resistant to tearing, scratching and cut-through. Further, the industry standard propagation requirement is not achievable with currently available conventional filling compounds and solid (non-foamed) insulation.

In addition, when communication cable is laid in long vertical runs, for example, up towers such as cell phone towers, if the viscosity is too low, a drip-wise loss of the filling compound can occur. Such dripping of the filling compound not only results in loss of the water blocking benefits imparted by the filling compound to the communications cable but can also cause fouling of equipment and components upon which dripping of the filling compound occurs.

Communication cable employing existing art filling compounds typically have a higher density and a lower molecular weight that translates, for example, into a lower viscosity at operating temperatures, and all experience dripping or running of the compound in such vertical installations. Commercially available non-drip filling compounds formulated specifically as a water blocking agent for communication cable, such as extended thermoplastic rubber (ETPR) or polyethylene modified petroleum jelly (PEPJ) have proven unsuitable because the resulting cable does not meet industry standards for propagation delay.

Some current designs have incorporated a barrier layer of polyethylene terephthalate (PET) to contain the compound within its contents. Another attempt to address the dripping problem is the use of an inner jacket of a material such as Mylar™ PET tape to retain the filling compound. Such attempts have been only partially successful in that the oil component of the filling compound seeps or migrates through or around the barrier layer or jacket over time. A related attempt to address the problem is use of a Mylar™ inner core wrap, which is likewise only partially successful and even more expensive.

Accordingly, to address these representative deficiencies in the art, what is needed is an improved capability to allow for an acceptable signal propagation delay or velocity of propagation in water blocked communication cable as required by communication cable industry specifications. Another need exists for a water blocked communication cable with an increased velocity of propagation that allows for the use of solid insulation of the conductors. A further need exists for a water blocked communication cable with such a filling compound with anti-dripping characteristics in vertical installations. A still further need exists for a water blocked communication cable with such a filling compound that significantly reduces the amount of material that is absorbed through the communication cable jacket.

A capability addressing one or more of these needs would significantly decrease the cost of making and using and significantly improve the performance of water blocked communication cable.

SUMMARY

Embodiments of the invention propose a water blocked communication cable, a method of making the water blocked communication cable, and a filling compound for the water blocked communication cable for embodiments of the invention. The cable for embodiments of the invention has an outer jacket defining an interior space, a plurality of conductors, such as a plurality of twisted conductor pairs, disposed within the interior space, and a thixotropic, cold pumpable filling compound disposed within the interior space between the plurality of conductors and the outer jacket. The filling compound for embodiments of the invention consists, for example, of a refined mineral oil base and an organic polymeric gelling agent with a dispersion of micro spheres and has a dielectric constant not greater than 1.8, and preferably between about 1.2 and about 1.6. The density of the filling compound for embodiments of the invention is not greater than 0.45 gm. per cu. cm and preferably between about 0.25 gm. per cu. cm. and 0.45 gm per cu. cm.

The discussion of water blocked communication cable presented in this summary is for illustrative purposes only. Various aspects of the present invention may be more clearly understood and appreciated from a review of the following detailed description of the disclosed embodiments and by reference to the drawings and the claims that follow. Moreover, other aspects, systems, methods, features, advantages, and objects of the present invention will become apparent to one with skill in the art upon examination of the following drawings and detailed description. It is intended that all such aspects, systems, methods, features, advantages, and objects are to be included within this description, are to be within the scope of the present invention, and are to be protected by the accompanying claims.

Figure 1:
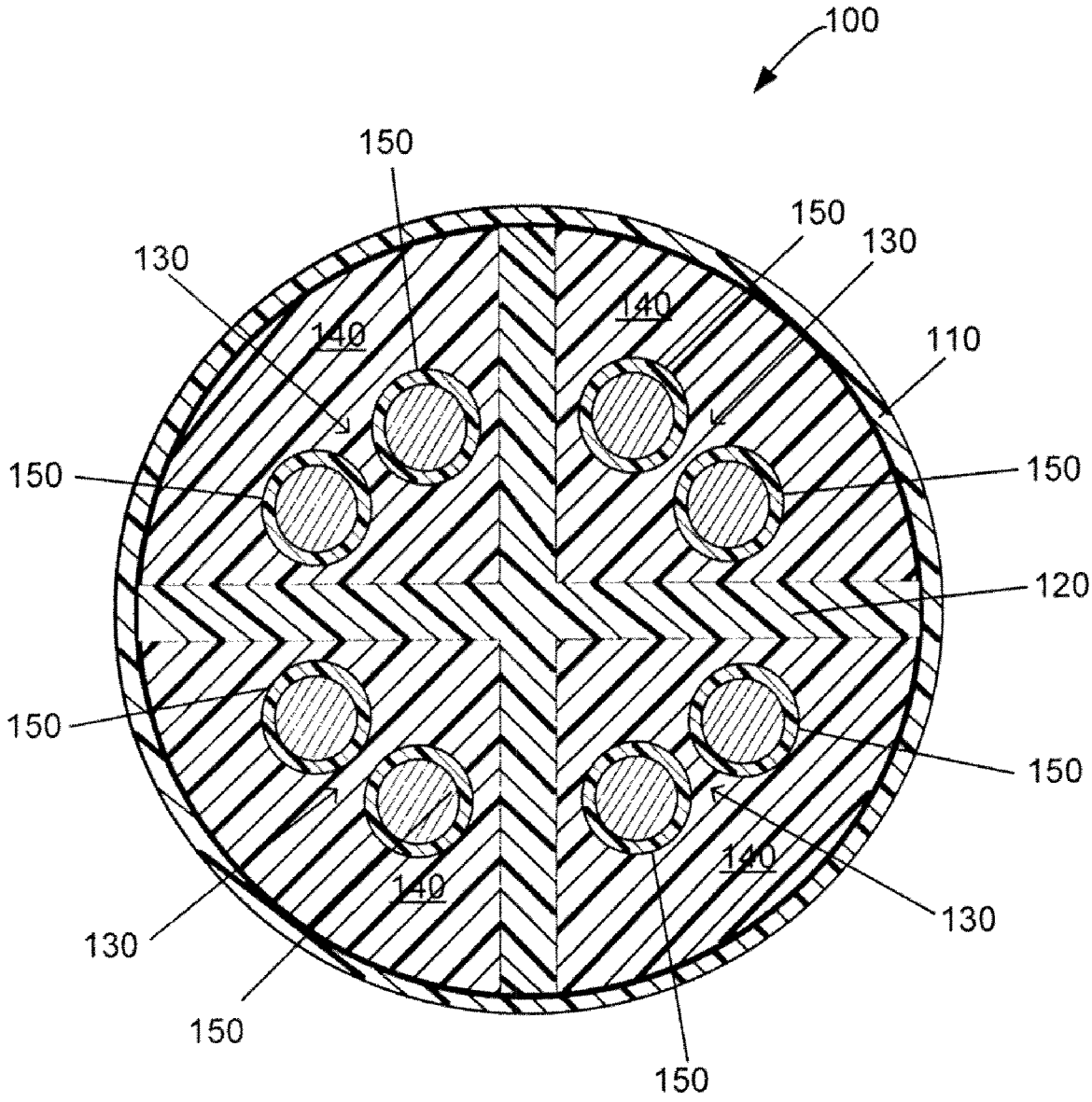
FIG. 1 is a cross-sectional view of an example embodiment of a water blocked communication cable comprising a thixotropic, cold pumpable water blocking filling compound having a reduced dielectric constant as well as a lower density and higher molecular weight for embodiments of the invention.

Many aspects of the invention can be better understood with reference to the above drawings. The elements and features shown in the drawings are not to scale, emphasis instead being placed upon clearly illustrating the principles of exemplary embodiments of the present invention. Moreover, certain dimension may be exaggerated to help visually convey such principles. In the drawings, reference numerals designate like or corresponding, but not necessarily identical, elements throughout the several views.

DETAILED DESCRIPTION OF EXEMPLARY EMBODIMENTS

Figure 2:
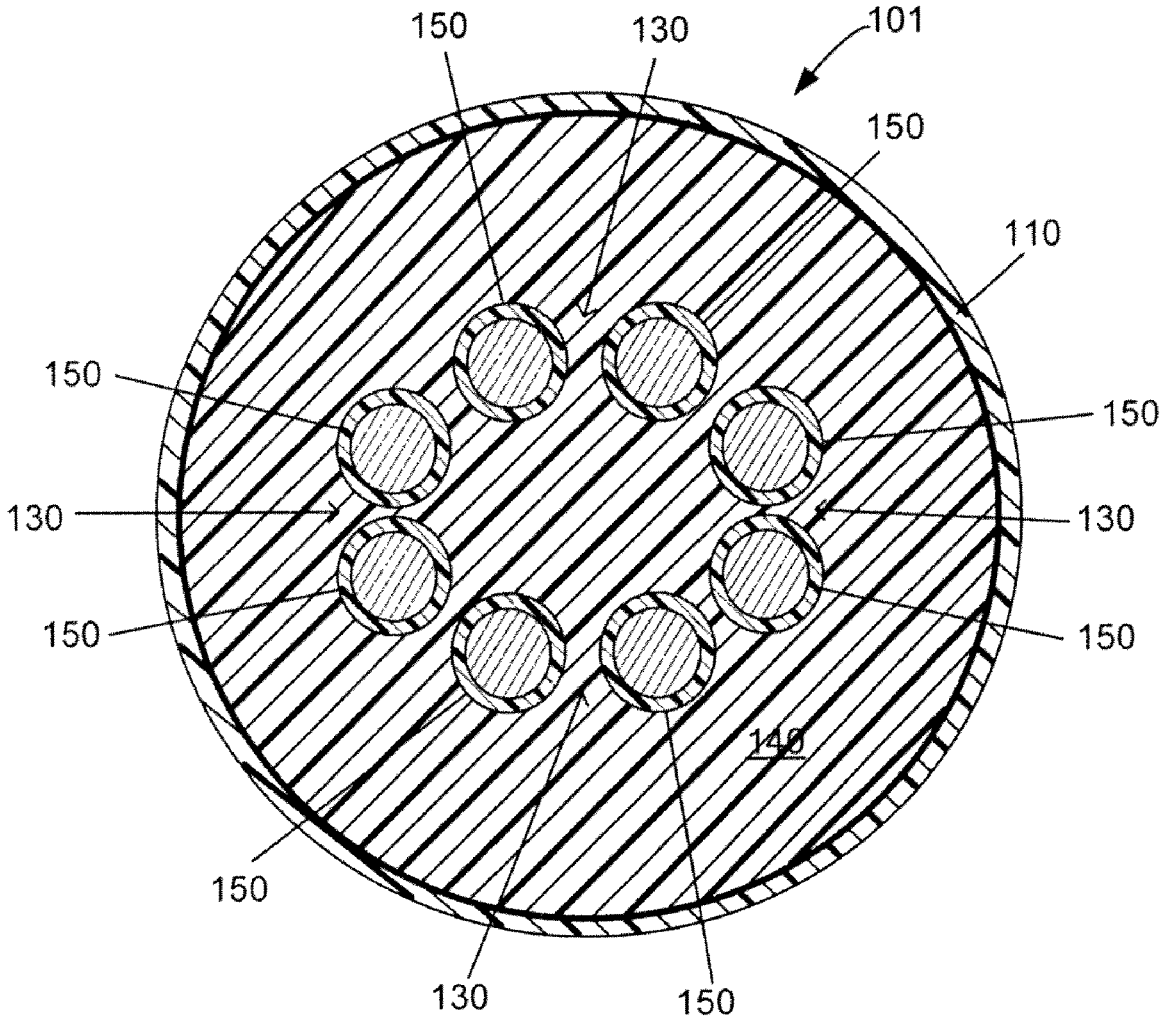
FIG. 2 is a cross-sectional view of another example embodiment of a water blocked communication cable comprising a thixotropic, cold pumpable water blocking filling compound having a reduced dielectric constant as well as a lower density and higher molecular weight for embodiments of the invention.

FIG. 1 is a cross-sectional view of an example embodiment of a water blocked communication cable 100 for embodiments of the invention, and FIG. 2 is a cross-sectional view of an another example embodiment of a water blocked communication cable 101 for embodiments of the invention. Referring to FIG. 1, the example communication cable 100 has an outer jacket 110, a cross-web load separator 120, four pairs of conductors 130 spaced a correct distance from one another by the separator 120, and the filling compound 140 for embodiments of the invention.

Referring to FIG. 2, the example communication cable 101 likewise has an outer jacket 110, four pairs of conductors 130, and the filling compound 140 for embodiments of the invention but has no cross-web load separator 120. It is to be understood that the particular type of communication cable is illustrative only and that embodiments of the invention include any other type of communication cable with a jacket, with or without a load separator, and any number of conductors or conductor pairs.

Embodiments of the invention propose to fill conventionally designed air core communication cable to provide increased water blocking ability without diminishing the electrical performance of the cable. According to embodiments of the invention, conventional filling compounds are replaced in such cable with a low density, high molecular weight filling compound 140. As used herein "high" or "higher" molecular weight means an average molecular weight that is greater than the average molecular weight of existing art filling compounds which translates, for example, into a lower viscosity at operating temperatures.

The filling compound 140 for embodiments of the invention is a thixotropic, cold pumpable material having a reduced dielectric constant as well as a lower density and higher molecular weight than conventional existing art filling compounds. According to embodiments of the invention, the filling compound 140 has a dielectric constant in the range of 1.8 or less, between 1.2 and 1.6, and preferably about 1.4; and a density of 0.45 gm. per cu. cm or less, between 0.25 gm. per cu. cm. and 0.45 gm. per cu. cm., and preferably about 0.35 gm. per cu. cm.

The low density, high molecular weight filling compound 140 for embodiments of the invention is based on refined mineral oil, but other oils such as extended thermoplastic rubber (ETPR), polyethylene modified petroleum jelly (PEPJ), or hot melt thermoplastics such as atactic polypropylene and polyisobutylene can be used to reduce the dielectric content of the filling compound as well.

The reduction in the dielectric constant and density is achieved at least in part by the incorporation of hollow, polymeric micro-spheres into the filling compound 140 for embodiments of the invention which displaces oil in the filling compound with gas contained within the micro-spheres. In embodiments of the invention, cable loss, capacitance and propagation delay are reduced effectively due to the lower dielectric constant of the filling compound 140, and the failing propagation delay margin for the communication cable is considerably reduced.

Examples of existing art filling compound with dispersed micro-spheres for communication cable are proposed in U.S. Pat. No. 7,253,217 and U.S. Published Application No. 2008/0076854 (a continuation of U.S. Pat. No. 7,253,217). An example of a similar type of commercially available existing art fiber optic cable filling compound with dispersed micro-spheres is offered by Unigel International under the designation UNIBLOCK UNILITE™ filling compound.

The UNIBLOCK UNILITE™ filling compound is a thixotropic, cold pumpable material based on a refined mineral oil and gelling agent mixture that is filled with micro spheres which reduce the density and dielectric constant below that of conventional ETPR filling compound. However, it has been found that off-the-shelf UNIBLOCK UNILITE™ filling compound does not have sufficiently low dielectric properties to overcome the propagation delay problems encountered, and communication cable in which the UNIBLOCK UNILITE™ filling compound is used does not meet industry standards for propagation delay.

Commercially available existing art fiber optic cable filling compound with dispersed micro-spheres, such as off-the-shelf UNIBLOCK UNILITE™ filling compound offered by Unigel has been found to be too dense because of the concentration of oil in the compound, resulting in a relatively high dielectric constant. In order to lower the density of the compound and thus lower the dielectric constant, an embodiment of the invention involves the inclusion of more micro-spheres (i.e., more gas) in the oil and gelling agent mixture of an existing art fiber optic cable filling compound with dispersed micro-spheres such as the UNIBLOCK UNILITE™ filling compound.

For example, a type of standard unshielded CAT 6 OSP communication cable that currently uses a conventional 80° C. ETPR filling compound which does not meet the propagation delay requirement of TIA/EIA-568-B.2 was instead filled with the commercially available UNIBLOCK UNILITE™ filling compound. While the commercially available UNIBLOCK UNILITE™ filling compound is a thixotropic, cold pumpable material based on refined mineral oil and filled with micro spheres that reduce the density and dielectric constant well below that of the conventional ETPR filling compound, with solid high density polyethylene (HDPE) insulation, use of the UNIBLOCK UNILITE™ filling compound resulted in a propagation delay margin (average for all pairs) of −3.3 ns and a range of −16.9 to +9.2.

In addition, a similar sample was made with slightly foamed (about 17% expansion) insulation and filled with the same density commercially available UNIBLOCK UNILITE™ filling compound, which produced a propagation delay margin (average for all pairs) of 28.8 ns and a range of 17.9 to 33.2 n. Additionally, similar samples containing the same slightly foamed and solid insulation cores were filled with a version of the UNIBLOCK UNILITE™ filling compound with a greater volume of micro spheres, resulting in a lower density compound, were jacketed and tested. These samples had propagation delay margin averages for all pairs of 34.3 ns and a range of 24.0 to 44.0 ns for the slightly foamed insulation and 9.2 ns and a range of −5.7 to 19.0 ns for the solid insulation.

In order to reduce the propagation delay for 24 AWG solid insulated conductors, so that all pairs were within specification, similar samples were made in which the pair lay lengths were increased slightly from the nominal values as used for the standard cable production of 0.38 in., 0.38 in., 0.49 in., and 0.45 in. to target/finished cable values of 0.43/0.43 in., 0.40/0.38 in., 0.52/0.49 in., and 0.49/0.47 in., respectively. The propagation delay margins for these samples averaged 12.3 ns with a range of 3.96 ns to 24.41 ns. A further sample was made with conventional 23 AWG conductors using the same filling compound with slightly longer target/finished cable lay pair lengths of 0.49/0.462 in., 0.46/0.438 in., 0.58/0.553 in., and 0.55/0.520 in. which also passed all electrical testing and had a propagation delay margin average of 13.1 ns and a range of 3.99 to 21.18 ns.

The filling compound 140 for embodiments of the invention includes a greater volume of micro-spheres filled with air, gaseous nitrogen or any other suitable gas having a similarly low dielectric constant dispersed in the filling compound than in typical, commercially available filling compounds such as the UNIBLOCK UNILITE™ filling compound. The dielectric constant of air is 1.0 which is a minimum, and the dielectric constant of gaseous nitrogen is only minutely greater than the dielectric constant of air. The inclusion of a greater volume of micro-spheres in the filling compound 140 for embodiments of the invention results in a lower dielectric constant, as well as a lower density of the filling compound 140.

The density of a typical commercially available filling compound with dispersed micro-spheres, such as the UNIBLOCK UNILITE™ filling compound, is in the range of 0.45 gm per cu. cm., while the filling compound 140 for embodiments of the invention has a density that is less than 0.45 gm. per cu. cm and preferably in the range of 0.25 gm per cu. cm to 0.45 gm. per cm. For example, excellent results can be achieved with a filling compound 140 for embodiments of the invention having a density of 0.35 gm. per cu. cm. or even less.

As previously mentioned, the filling compound 140 for embodiments of the invention has a dielectric constant that is lower than the dielectric constant of commercially available filling compounds typically utilized in the communications cable industry. For example, the dielectric constant for an industry standard ETPR type of filling compound is in the range of 1.9, and the dielectric constant for typical filling compounds with dispersed micro-spheres, such as the commercially available UNIBLOCK UNILITE™ filling compound, is in the range of 1.6. On the other hand, the filling compound 140 for embodiments of the invention has a dielectric constant of 1.4 or less.

Referring further to FIG. 1, the water blocked communication cable 100 for embodiments of the invention has the space within the cable jacket 110 filled with the filling compound 140 for embodiments of the invention. More specifically, the space between the load separator 120 and conductor pairs 130 within the cable jacket 110 is filled with the low density, thixotropic filling compound 140 for embodiments of the invention that blocks moisture from entering the communication cable 100.

Figure 3:
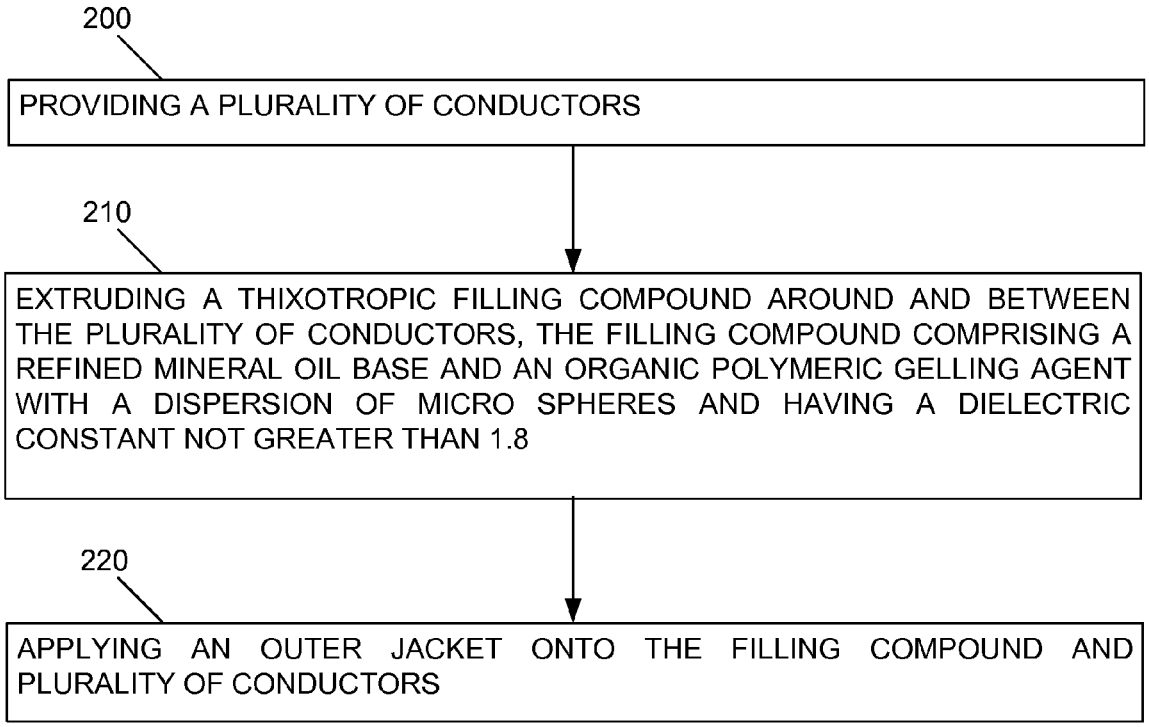
FIG. 3 is a flow chart which illustrates an example of the process of making a water blocked communication cable for embodiments of the invention.

FIG. 3 is a flow chart which illustrates an example of the process of making a water blocked communication cable for embodiments of the invention. Referring to FIG. 3, at 200, a plurality of conductors is provided and at 210 a thixotropic filling compound is extruded around and between the plurality of conductors, which filling compound comprises a refined mineral oil base and an organic polymeric gelling agent with a dispersion of micro spheres and has a dielectric constant not greater than 1.8. At 220, an outer jacket is applied onto the filling compound and plurality of conductors which are disposed within an interior space defined by the outer jacket.

An important feature of the filling compound 140 employed for embodiments of the invention is its cold pumpability which results from its thixotropy and allows pumping of the filling compound 140 without applying heat to the filling compound 140. Further, the filling compound 140 remains flexible and does not become stiff at relatively low ambient temperatures. When the compound 140 goes through a pumping mechanism and undergoes shear stress, the viscosity of the compound 140 decreases. While the compound 140 is being pumped into the cable 100, the viscosity of the compound 140 is similar to that of the base oil in the compound 140, but the compound 140 gels after it is inside the cable 100 for a period of time.

Use of a thixotropic filling compound eliminates the need for heating equipment which is used to lower the viscosity of filling compound in order to assure that the filling compound flows readily into the interstices of the cable. The cold pumpability feature of the filling compound 140 for embodiments of the invention is important at least in part because when heated filling compound comes into contact with the communication cable during processing, there is a significant potential for corresponding heating of the cable insulation which can result in deforming the insulation.

While some existing art thixotropic filling compound is occasionally employed by some manufacturers in communication cables, such filling compounds have not been widely utilized because of their greater expense. In addition, a significant disadvantage of communication cable in which existing art thixotropic filling compounds are used is that such compounds create signal propagation difficulties in the cable and do not satisfy communication cable propagation requirements of the industry.

Another aspect of embodiments of the invention involves an increase in the twist lay lengths of the conductor pairs, for example, in CAT6 communication cable in a range of four to twenty-six percent in addition to lowering the density and dielectric constant of the filling compound 140 for embodiments of the invention. Such an increase in the lay lengths also allows for a reduction in the high density polyethylene (HDPE) copper insulation, for example, in CAT6 communication cable in the range of six to nine percent or more.

Thus, in embodiments of the invention, to achieve the industry standard propagation delay using the filling compound 140 for embodiments of the invention, the twist length can also be adjusted. Embodiments of the invention propose a combination of thixotropic fiber water blocking filling compound with dispersed micro spheres, such as commercially available UNIBLOCK UNILITE™ filling compound with an increased volume of micro spheres dispersed in the oil and gelling agent mixture for lower density coupled, for example, with insulation thickness and twist lay adjustments to achieve the desired communication cable propagation delay and impedance.

Because the propagation delay is measured relative to the length of the cable, the unraveled length of twisted conductors in the communication cable 100 would be significantly longer than their twisted length. Consequently, a signal takes longer to travel through twisted conductors of a cable of a certain length then through straight (non-twisted) conductors of a cable of the same length. Embodiments of the invention involve increasing the twist length for each of the conductors or the conductor pairs 130 in the communications cable 100, which in effect makes each conductor straighter, i.e., closer to the actual length of the communication cable 100.

In order to minimize cross talk between conductor pairs, conductor pairs are typically provided with different twist lay lengths. However, the variation between twist lay lengths cannot be too great as it may cause the cable to fail to meet industry standard skew requirements, i.e. the difference between the fastest and slowest signals is too great. Typical lay lengths used in communication cable with an existing art filling compound, such as ETPR, have been found to yield less than satisfactory propagation delay results even with the filling compound 130 for embodiments of the invention.

As previously noted, it has been found that an increased twist lay length for each conductor pair 130 in the communication cable 100 in the range of four to twenty-six percent or more, i.e., a reduction in the amount of twist for each conductor pair 130 results in satisfactorily meeting the industry standard propagation delay requirements. While other twist lay length adjustments can achieve similar results, such as increasing the twist lay length of only one conductor or of some other number less than all of the conductor pairs, the least expensive and uncomplicated adjustment is an increase in the twist lay lengths of all of the conductor pairs. That is at least in part because increasing the twist lay lengths of all the conductor pairs results in using less conductor material in the manufacturing process.

As previously noted, an aspect of embodiments of the invention is an anti-drip quality when communication cable 100 according to embodiments of the invention is run up a cell phone tower or similar installation in which the cable 100 is disposed in a vertical orientation. The thixotropic filling compound 140 for embodiments of the invention has an increased viscosity in the absence of the application of shear which enables the filling compound 140 to pass industry standard filling compound drip tests. Thus, embodiments of the invention employ a filling compound 140 that both blocks water from entering the communication cable 100 and provides anti-dripping characteristics in vertical installations, such as towers.

The increased velocity of propagation provided by the water blocked communication cable 100 for embodiments of the invention also allows for the use of solid insulation of the conductors in the cable. Depending on the presence of, or if present, the type of, filling compound, it is necessary to adjust the insulation thickness in order to achieve the industry standard 100 ohms impedance, which in turn sacrifices propagation delay. Embodiments of the invention also involve, for example, adjusting the insulation thickness in order to meet all the proper industry standards.

According to embodiments of the invention, the insulation thickness of the cable can be adjusted to achieve the industry standard propagation delay while meeting the industry standard 100 ohms impedance using the filling compound 140 for embodiments of the invention. Embodiments of the invention involve, for example, decreasing the insulation thickness to less than the insulation thickness of commercially available existing art communication cable that utilizes filling compound such as ETPR or the off-the-shelf UNIBLOCK UNILITE™ filling compound with micro-spheres. Such a decrease in the insulation thickness results in a reduced impedance for the communication cable 100 for embodiments of the invention that meets industry standard requirements for impedance as well as propagation delay.

The filling compound 140 for embodiments of the invention employs an oil in the oil and gelling agent mixture in which the micro spheres are dispersed that has a molecular weight that is higher than that of oils utilized in currently commercially available filling compounds, which significantly reduces the amount of filling compound material that is absorbed through the communication cable jacket 110. This reduction in absorption eliminates the need for a barrier layer.

The average molecular weight of the filling compound 140 for embodiments of the invention is greater than the molecular weight of typical, commercially available communication cable filling compounds. The higher average molecular weight of the filling compound 140 for embodiments of the invention improves the anti-seeping characteristics of the filling compound 140 such that seepage of the filling compound through the jacket 110 of the cable 100 is avoided.

Technology for a water blocked communication cable has been described. From the description, it will be appreciated that an embodiment of the present invention overcomes the limitations of the prior art. Those skilled in the art will appreciate that the present invention is not limited to any specifically discussed application or implementation and that the embodiments described herein are illustrative and not restrictive. From the description of the exemplary embodiments, equivalents of the elements shown therein will suggest themselves to those skilled in the art, and ways of constructing other embodiments of the present invention will appear to practitioners of the art. Therefore, the scope of the present invention is to be limited only by the claims that follow.

What is claimed is:

1. A cable comprising:

an outer jacket defining an interior space;

a plurality of conductors disposed within the interior space;

a thixotropic filling compound disposed throughout the interior space between the plurality of conductors and the outer jacket and surrounding said plurality of conductors, the filling compound comprising a refined mineral oil base and an organic polymeric gelling agent with a dispersion of micro spheres and having a dielectric constant of 1.2 to 1.6 and a density of 0.25 gm. per cu. cm to 0.45 gm. per cu. cm.

2. The cable of claim 1, wherein the plurality of conductors further comprises a plurality of twisted pairs of conductors within the interior space.

3. The cable of claim 1, wherein the plurality of conductors further comprises at least four twisted pairs of conductors within the interior space having lay lengths of 0.3 inch to 0.7 inch, respectively.

4. The cable of claim 1, wherein the plurality of conductors further comprises at least four twisted pairs of conductors within the interior space having insulation thicknesses of 0.004 inch to 0.017 inch, respectively.

5. The cable of claim 1, wherein the plurality of conductors further comprises a plurality of twisted pairs of conductors spaced from one another within the interior space.

6. The cable of claim 1, wherein the thixotropic filling compound further comprises a thixotropic filling compound that is cold-pumpable.

7. The cable of claim 1, wherein the filling compound has a dielectric constant of about 1.4.

8. The cable of claim 1, wherein the filling compound has a density of about 0.35 gm. per cu. cm.

9. A method of making a cable comprising:

providing a plurality of conductors;

extruding a thixotropic filling compound around and between the plurality of conductors, the filling compound comprising a refined mineral oil base and an organic polymeric gelling agent with a dispersion of micro spheres and having a dielectric constant of 1.2 to 1.6 and a density of 0.25 gm. per cu. cm to 0.45 gm. per cu. cm; and applying an outer jacket onto the filling compound and plurality of conductors.

10. The method of claim 9, wherein providing the plurality of conductors further comprises providing a plurality of twisted pairs of conductors.

11. The method of claim 9, wherein providing the plurality of twisted pairs of conductors further comprises a providing a plurality of twisted pairs of conductors spaced from one another.

12. The cable of claim 9, wherein the thixotropic filling compound further comprises a thixotropic filling compound that is cold-pumpable.

13. The method of claim 9, wherein the filling compound has a dielectric constant of about 1.4.

14. The method of claim 9, wherein the filling compound has a density of about 0.35 gm. per cu. cm.

15. A thixotropic filling compound for cable comprising:

a refined mineral oil base;

an organic polymeric gelling agent blended with the mineral oil base;

a plurality of micro spheres dispersed in the blend of mineral oil and gelling agent; and the blend of mineral oil and gelling agent with dispersed micro spheres having a dielectric constant of 1.2 to 1.6 and a density of 0.25 gm. per cu. cm to 0.45 gm. per cu. cm.

16. The filling compound of claim 15, the blend of mineral oil and gelling agent with dispersed micro spheres being cold-pumpable.

17. The filling compound of claim 15, the blend of mineral oil and gelling agent with dispersed micro spheres having a dielectric constant of about 1.4.

18. The filling compound of claim 15, the blend of mineral oil base gelling agent and micro spheres having a density of about 0.35 gm. per cu. cm.

* * * * *